US010335746B2

(12) United States Patent
Schultz et al.

(10) Patent No.: US 10,335,746 B2
(45) Date of Patent: Jul. 2, 2019

(54) METHOD AND APPARATUS FOR VARIATION OF FLOW TO ERODE SOLID CHEMISTRY

(71) Applicant: ECOLAB USA INC, Saint Paul, MN (US)

(72) Inventors: Andrew Max Schultz, Minneapolis, MN (US); Jared R. Freudenberg, St. Louis Park, MN (US); Ryan Joseph Drake, White Bear Lake, MN (US); Brian Philip Carlson, Lakeville, MN (US); Ryan Jacob Urban, Plymouth, MN (US); Brian Doffing, Arden Hills, MN (US)

(73) Assignee: Ecolab USA Inc., Saint Paul, MN (US)

( * ) Notice: Subject to any disclaimer, the term of this patent is extended or adjusted under 35 U.S.C. 154(b) by 8 days.

(21) Appl. No.: 15/480,039

(22) Filed: Apr. 5, 2017

(65) Prior Publication Data

US 2017/0203263 A1 Jul. 20, 2017

Related U.S. Application Data

(63) Continuation of application No. 14/182,344, filed on Feb. 18, 2014, now Pat. No. 9,643,143.

(Continued)

(51) Int. Cl.

| | |
|---|---|
| ***B01F 1/00*** | (2006.01) |
| ***B01F 15/02*** | (2006.01) |
| ***B01F 15/00*** | (2006.01) |

(52) U.S. Cl.

CPC ..... *B01F 1/0033* (2013.01); *B01F 1/0038* (2013.01); *B01F 15/00253* (2013.01); *B01F 15/0261* (2013.01); *B01F 2215/0077* (2013.01)

(58) Field of Classification Search

CPC ..... B01F 1/0033; B01F 2001/0061; B01F 2001/0094; B01F 1/0027; G05D 23/02; G05D 23/022; G05D 23/024

(Continued)

(56) References Cited

U.S. PATENT DOCUMENTS

| | | | |
|---|---|---|---|
| 3,864,090 | A | 2/1975 | Richards |
| 4,398,669 | A | 8/1983 | Fienhold |

(Continued)

FOREIGN PATENT DOCUMENTS

| | | |
|---|---|---|
| EP | 0225859 | 10/1993 |
| WO | 2010027625 A1 | 3/2010 |

OTHER PUBLICATIONS

Ecolab USA Inc., PCT/US2014/016978 filed Feb. 18, 2014, "The International Search Report and the Written Opinion of the International Searching Authority, or the Declaration", dated Jun. 19, 2014.

Ecolab USA Inc, Application No. 14754429.0/PCT/US2014/016978, "Extended European Search Report" 8 pages, dated Nov. 29, 2016.

*Primary Examiner* — Tony G Soohoo
*Assistant Examiner* — Elizabeth Insler
(74) *Attorney, Agent, or Firm* — McKee, Voorhees & Sease, PLC

(57) ABSTRACT

A method and apparatus for obtaining a product chemistry from a product and a fluid is provided. A product is housed within a dispenser. A fluid is introduced through a manifold diffuse member having a plurality of ports. A cover is positioned adjacent the manifold diffuse member and includes a plurality of ports. The cover is able to be adjusted, for example, by rotating the cover, to align and un-align the manifold diffuse ports and the cover ports. This adjustment controls the flow characteristics of the fluid through the manifold diffuse member and cover to control the characteristics of the fluid in contact with the product. The adjust- (Continued)

ment of the cover to control the flow will provide a generally consistent concentration and erosion rate based upon known relationships between a characteristic of the fluid and the flow of the fluid in relation to the product.

15 Claims, 10 Drawing Sheets

Related U.S. Application Data

(60) Provisional application No. 61/766,774, filed on Feb. 20, 2013.

(58) Field of Classification Search
USPC ..... 366/151.1
See application file for complete search history.

(56) References Cited

U.S. PATENT DOCUMENTS

| | | | | |
|---|---|---|---|---|
| 4,790,981 | A | 12/1988 | Mayer et al. | |
| 5,389,344 | A * | 2/1995 | Copeland | A47L 11/30 134/93 |
| 5,427,748 | A | 6/1995 | Wiedrich et al. | |
| 5,441,073 | A * | 8/1995 | Hoadley | A01C 23/042 137/268 |
| 5,878,781 | A * | 3/1999 | Parker | F16K 11/0743 137/625.43 |
| 5,897,770 | A * | 4/1999 | Hatch | B01D 24/08 210/101 |
| 2005/0244315 | A1 | 11/2005 | Greaves et al. | |
| 2006/0083668 | A1 | 4/2006 | Thomas | |
| 2012/0260997 | A1 | 10/2012 | Snetting et al. | |
| 2012/0273585 | A1 * | 11/2012 | Broome | B01F 1/0033 239/10 |

* cited by examiner

METHOD AND APPARATUS FOR VARIATION OF FLOW TO ERODE SOLID CHEMISTRY

CROSS-REFERENCE TO RELATED APPLICATIONS

This application is a Continuation Application of U.S. Ser. No. 14/182,344, filed Feb. 18, 2014, which claims priority under 35 U.S.C. § 119 to provisional application Ser. No. 61/766,774, filed Feb. 20, 2013, all of which are herein incorporated by reference in their entirety.

FIELD OF THE INVENTION

The present invention relates generally to the formation of a product chemistry between a solid product chemistry and a fluid in contact with the solid product. More particularly, but not exclusively, the invention relates to a method and apparatus for adjusting the liquid in contact with the solid product chemistry to obtain a desired concentration of product chemistry and to provide a generally uniform erosion of the product.

BACKGROUND OF THE INVENTION

Dissolution parameters of a solid product into a liquid solution, such as a liquid detergent used for cleaning and sanitizing, change based on the operating parameters of and inputs to the dissolution process. Spraying liquid onto a solid product to dissolve it into a liquid solution is one technique. With this technique, the operating parameters change in part based on characteristics within the dispenser, such as the distance between the solid product and the spray nozzle and the change in the pressure and temperature of the liquid being sprayed onto the solid product. Changes in a nozzle's flow rate, spray pattern, spray angle, and nozzle flow can also affect operating parameters, thereby affecting the chemistry, effectiveness, and efficiency of the concentration of the resulting liquid solution. In addition, dissolution of a solid product by spraying generally requires additional space within the dispenser for the nozzles spray pattern to develop and the basin to collect the dissolved product, which results in a larger dispenser.

Spraying the liquid onto the solid product chemistry may not be ideal. The liquid temperature may vary, which will produce varying concentrations of the solution formed between the chemistry and the liquid. In addition, spraying the liquid may not provide uniform erosion, as the water contacts the chemistry in a non-uniform manner. This could create uncertainties in the system, as it will not be clear when or how often the product needs to be replaced, or what the concentration of the produced solution is.

Using a turbulent pool or pool-like liquid source may be used to combat some of the issues. However, similar to spraying, changes in characteristics of the liquid or environment may still affect the concentration and erosion rate of the product chemistry. For example, the temperature of the liquid and flow characteristics of the liquid in contact with the solid product are but a few of the parameters that may affect the concentration of the solution and/or the erosion rate of the product.

Therefore, there exists a need in the art for a method and apparatus for adjusting the flow characteristics of the liquid in contact with a solid product chemistry to account for changes in the characteristics of the liquid and/or product to obtain and maintain a desired concentration, as well as to provide for a more uniform erosion of the product.

SUMMARY OF THE INVENTION

Therefore, it is principal object, feature, and/or advantage of the present invention to provide an apparatus that overcomes the deficiencies in the art.

It is another object, feature, and/or advantage of the present invention to provide a method and apparatus for obtaining and maintaining a concentration of a product chemistry produced by a liquid in contact with a solid product chemistry.

It is yet another object, feature, and/or advantage of the present invention to provide a method and apparatus that allows for the flow of a liquid in contact with a solid product chemistry to be adjusted.

It is still another object, feature, and/or advantage of the present invention to provide an apparatus that will automatically adjust the flow of a liquid based upon a change in temperature of the liquid.

It is a further object, feature, and/or advantage of the present invention to provide an apparatus that can be manually adjust the flow of a liquid based upon a change in temperature of the liquid.

It is still a further object, feature, and/or advantage of the present invention to provide a dispenser that includes an adjustable flow rate to provide uniform erosion of a solid product chemistry.

It is yet a further object, feature, and/or advantage of the present invention to provide a dispenser providing a consistent concentration and product planning characteristics for replacing a solid product chemistry.

These and/or other objects, features, and advantages of the present invention will be apparent to those skilled in the art. The present invention is not to be limited to or by these objects, features and advantages. No single embodiment need provide each and every object, feature, or advantage.

According to an embodiment of the invention, a method for forming a product chemistry from a solid product and a liquid is provided. The method includes providing a solid product, introducing a liquid through a plurality of ports in a manifold diffuse member positioned adjacent the solid product, and adjusting the characteristics of liquid allowed through the ports in the manifold diffuse to obtain and maintain a concentration for the product chemistry.

The amount of liquid can be adjusted by selectively blocking or unblocking at least some of the ports with a cover. The cover can be rotated to adjust the alignment of the cover ports and the manifold diffuse member ports to adjust the amount of liquid allowed through, which can be done manually or automatically.

According to another aspect of the invention, an apparatus for adjusting the amount of a liquid contacting a solid product to form a product chemistry is provided. The apparatus includes a manifold diffuse member comprising a plurality of ports therethrough and a cover positioned adjacent the manifold diffuse member and comprising a plurality of ports therethrough. The cover is adjustable relative to the manifold diffuse member to adjust the alignment of the manifold diffuse ports and the cover ports to adjust the flow of the liquid contacting the solid product.

According to yet another aspect of the invention, a dispenser configured to obtain a product chemistry from a solid product and a liquid is provided. The dispenser includes a housing, a cavity within the housing for holding the solid product, a liquid source adjacent the cavity for providing a liquid to contact the solid product to create a product chemistry, a manifold diffuse member adjacent the liquid source and comprising a plurality of ports therethrough to allow a flow of the liquid to contact the solid product, and a cover positioned adjacent the manifold diffuse member and comprising a plurality of ports therethrough. The cover is adjustable relative to the manifold diffuse member to adjust the alignment of the manifold diffuse ports and the cover ports to adjust the flow of the liquid contacting the solid product.

DETAILED DESCRIPTION OF THE PREFERRED EMBODIMENTS

Figure 1:
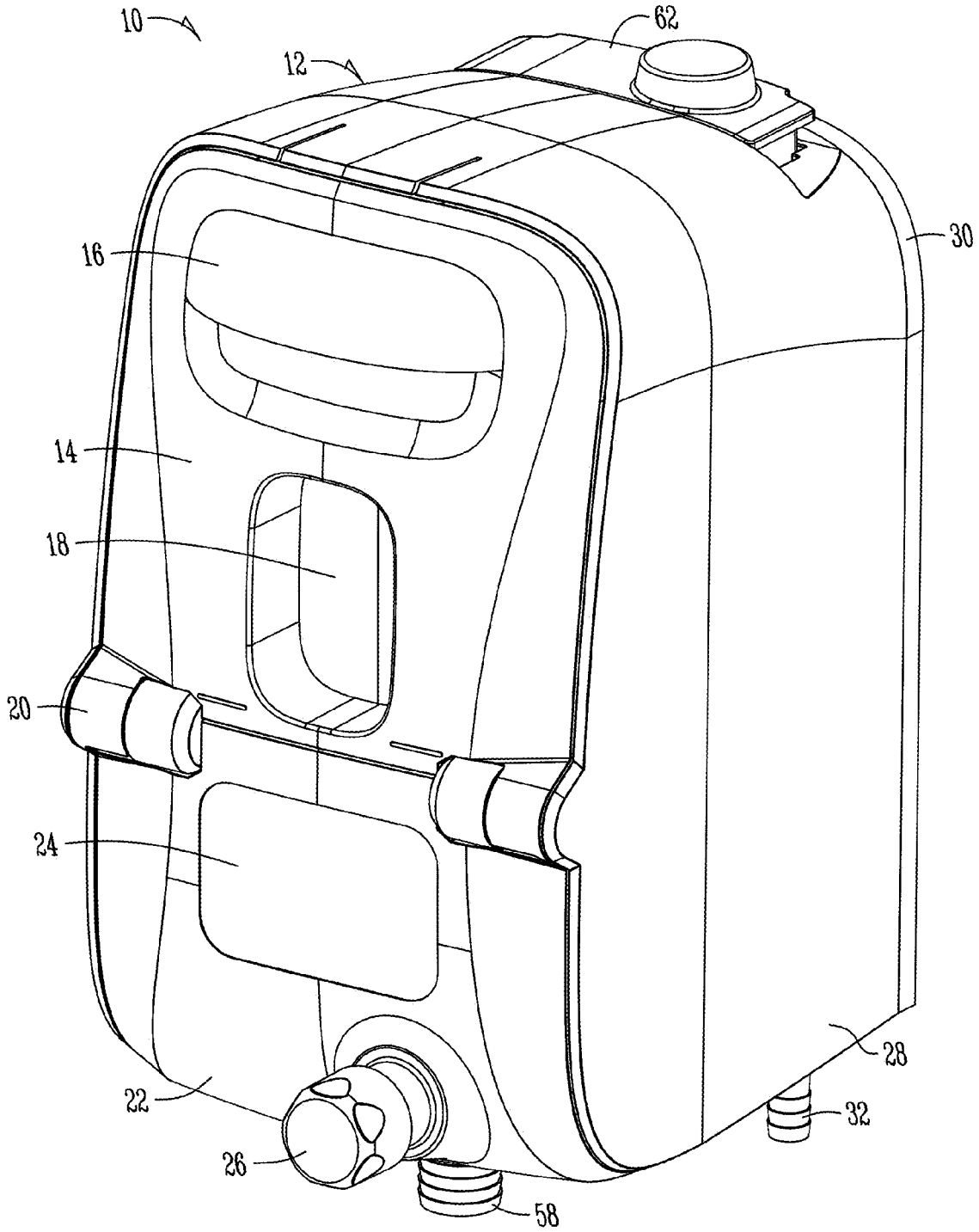
FIG. 1 is a perspective view of an embodiment of a dispenser.

FIG. 1 shows an exemplary embodiment of a dispenser 10 for use with the present invention. However, it should be noted that other types and configurations of dispensers may be used with the invention, and the description and figures of the dispenser 10 are not to be limiting. The dispenser 10 is configured to hold a solid product chemistry that is combined with a liquid, such as water, to create a product chemistry. For example, the solid product chemistry may be mixed with the liquid to create a cleaning detergent. However, it should also be appreciated that the product could be mixed with any fluid, such as steam, air, or other gases that erode the product to create a usable chemistry. For example, the solid product could be eroded with a gas or other fluid to create a powder that is dispensed from the dispenser 10 to an end use, such as an appliance. In such a situation, the product could be a solid laundry detergent, which needs to be eroded to powder-like form to be added to a washing machine. The detergent could be eroded by a fluid, such as air or another gas, and the result could be then dispensed into the washing machine, where it will mix with water or other liquids, as is known, to create a liquid detergent for cleaning items.

According to some embodiments, the dispenser 10 works by having the liquid interact with the solid product to form a product chemistry having a desired concentration for its end use application. The liquid may be introduced to a bottom or other surface of the solid product, as will be discussed below. However, as mentioned, a problem can exist in obtaining and/or maintaining a desired concentration of the product chemistry.

Therefore, the dispenser 10 of the invention includes a novel turbulence or flow scheme control that is adjustable either manually or in real time (i.e., automatically) based on a characteristic of either the solid product or another uncontrolled condition, such as an environmental condition. The characteristic may be the density of the solid product, the temperature or pressure of the liquid, the climate (humidity, temperature, pressure, etc.) of the room in which the dispenser or solid product is placed, the type of liquid/fluid used, the number of solid products used, or some combination thereof. The dispenser 10 can be adjusted, such as adjusting a characteristic of the existing flow scheme or turbulence. The adjustments may be made based the use of known relationships between the characteristic and the erosion rate of the solid product, as well as the relationship between different types of turbulence and the erosion rate of the solid product.

As mentioned, the turbulence or flow characteristics/scheme can be adjusted based upon known relationships between the characteristic(s) and the dispense rate of the solid chemistry. For example, by understanding the rate change of product dispense per change in degree of liquid temperature change, the turbulence can be adjusted to counteract a temperature change. The concentration is adjusted according to known relationships between the erosion or dispense rate and either the characteristic or the turbulence.

According to the exemplary embodiment, the dispenser 10 of FIG. 1 includes housing 12 comprising a front door 14 having a handle 16 thereon. The front door 14 is hingeably connected to a front fascia 22 via hinges 20 therebetween. This allows the front door 14 to be rotated about the hinge 20 to allow access into the housing 12 of the dispenser 10. The front door 14 also includes a window 18 therein to allow an operator to view the solid product housed within the housing 12. Once the housed product has been viewed to erode to a certain extent, the front door 14 can be opened via the handle to allow an operator to replace the solid product with a new un-eroded product.

The front fascia 22 may include a product ID window 24 for placing a product ID thereon. The product ID 24 allows an operator to quickly determine the type of product housed within the housing 12 such that replacement thereof is quick and efficient. The ID 24 may also include other information, such as health risks, manufacturing information, date of last replacement, or the like. Also mounted to the front fascia 22 is a button 26 for activating the dispenser 10. The button 26 may be a spring-loaded button such that pressing or depressing of the button activates the dispenser 10 to discharge an amount of product chemistry created by the solid product and the liquid. Thus, the button 26 may be preprogrammed to dispense a desired amount per pressing of the button, or may continue to discharge an amount of product chemistry while the button is depressed.

Connected to the front fascia 22 is a rear enclosure 28, which generally covers the top, sides, and rear of the dispenser 10. The rear enclosure 28 may also be removed to access the interior of the dispenser 10. A mounting plate 30 is positioned at the rear of the dispenser 10 and includes means for mounting the dispenser to a wall or other structure. For example, the dispenser 10 may be attached to a wall via screws, hooks, or other hanging means attached to the mounting plate 30.

The components of the housing 12 of the dispenser 10 may be molded plastic or other materials, and the window 18 may be a transparent plastic such as clarified polypropylene or the like. The handle 16 can be connected and disconnected from the front door 14. In addition, a backflow prevention device 62 may be positioned at or within the rear enclosure 28 to prevent backflow of the product chemistry.

Figure 2:
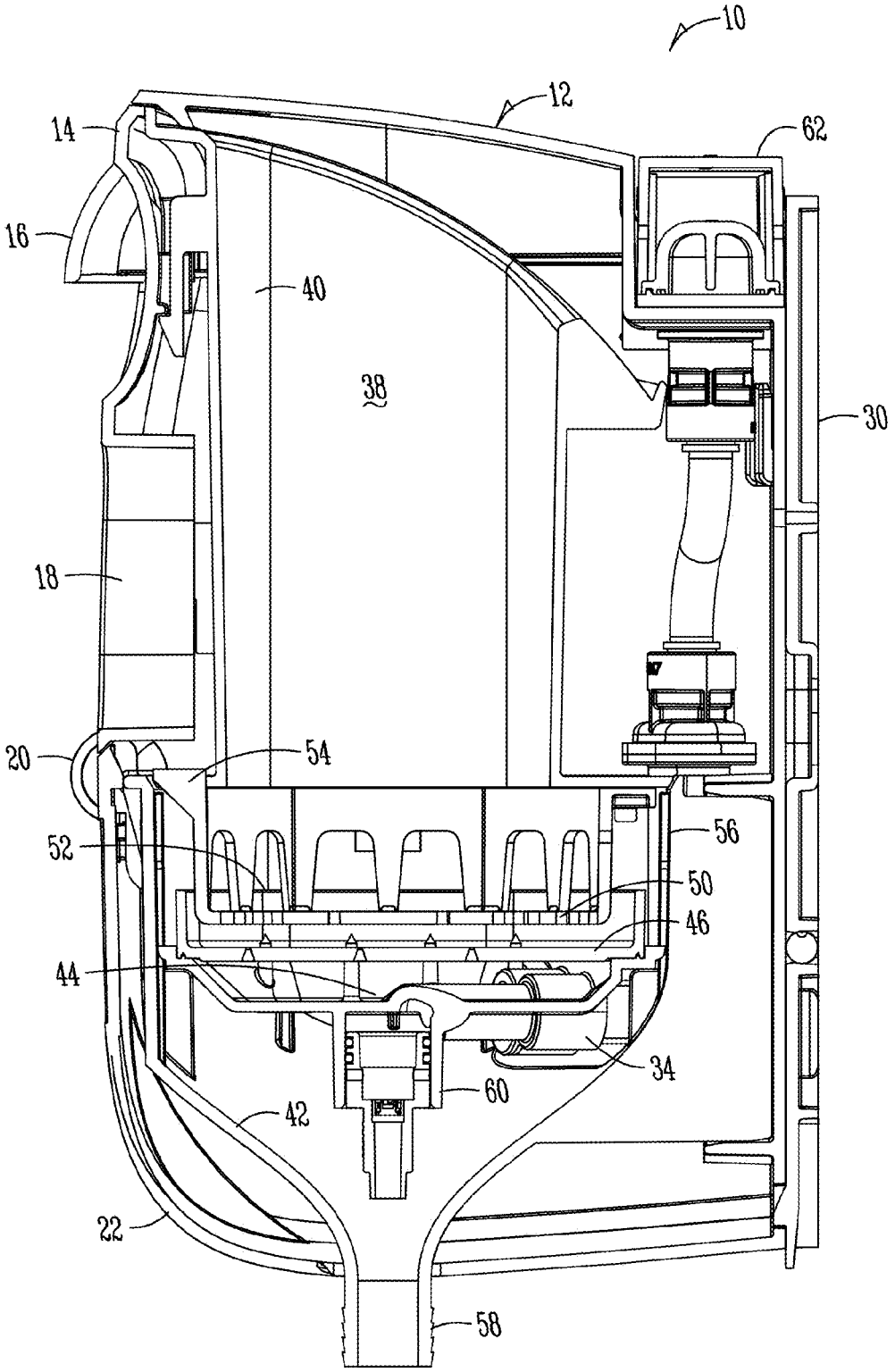
FIG. 2 is a side sectional view of the dispenser of FIG. 1.
Figure 3:
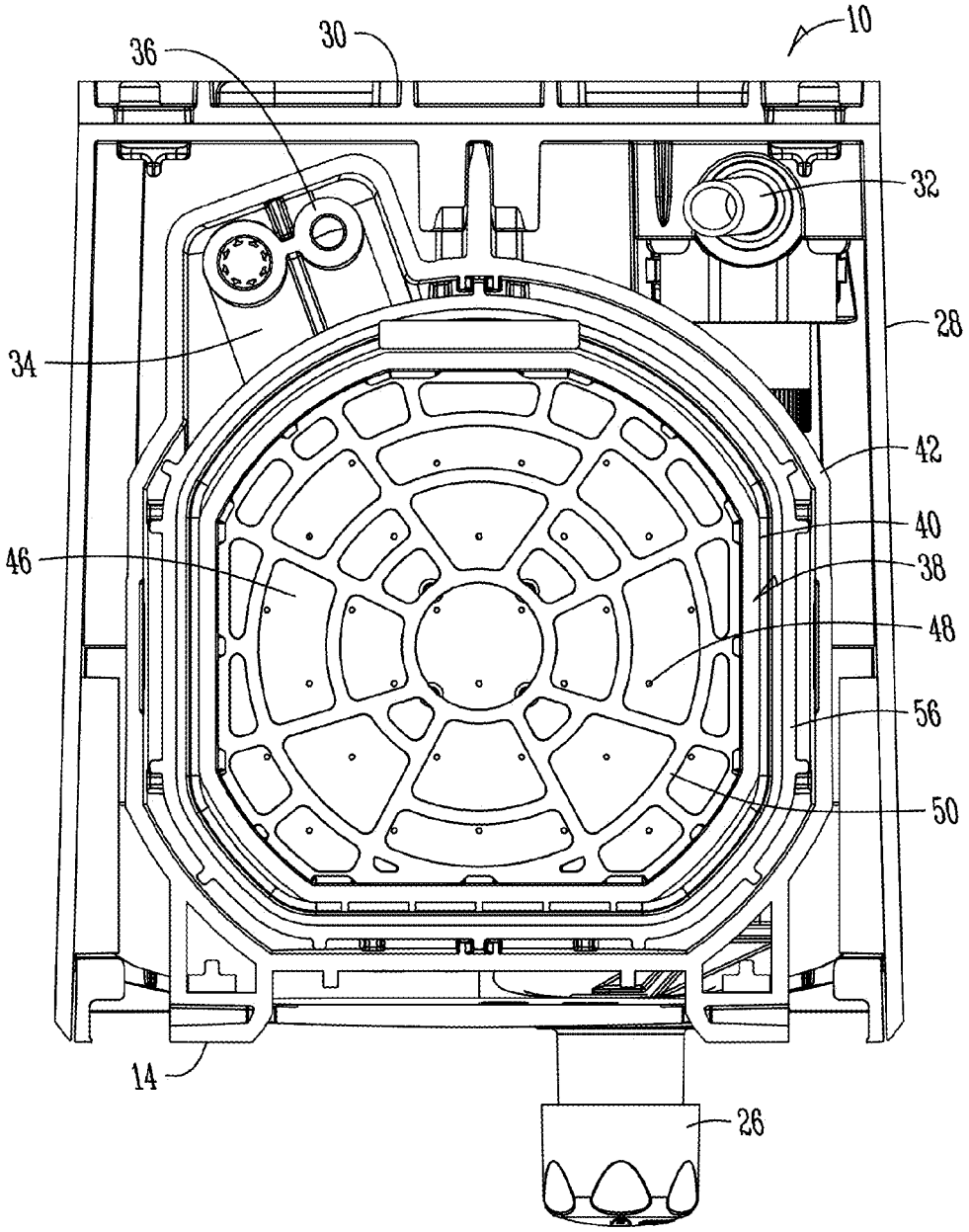
FIG. 3 is a top sectional view of the dispenser of FIG. 1.

FIGS. 2 and 3 are side and top sectional views of the dispenser 10. A solid product is placed within a cavity 38, which is surrounded by walls 40. The solid product chemistry is placed on a support member 50, which is shown to be a product grate comprising interlocking wires. A liquid, such as water, is connected to the dispenser 10 via the liquid inlet 32 shown in FIG. 3 on the bottom side of the dispenser 10. The liquid is connected to the button 26 such that pressing the button will pass liquid into the dispenser 10 to come in contact with the product chemistry. The liquid is passed through a liquid source 34 via a fitment splitter 36. As shown, the liquid source 34 is a split, two channel liquid source for different flow paths. Each of the paths contains a flow control (not shown) to properly distribute liquid in the intended amounts. This flow control can be changed to alter the turbulence of the liquid coming in contact with the solid product to adjust the turbulence based on the characteristics to maintain the formed product chemistry within an acceptable range of concentration. For example, the liquid may pass through the liquid source 34 and out the liquid source nozzle 44. The liquid source nozzle 44 is positioned adjacent a manifold diffuse member 46, which may also be known as a puck member, such that the liquid passing through the liquid nozzle 44 will be passed through manifold diffuse ports 48 of the manifold diffuse member 46.

Furthermore, the invention contemplates that, while positioned on the support member 50, the product chemistry may be fully submerged, partially submerged, or not submerged at all. The submersion level, or lack thereof, can be dependent upon many factors, including, but not limited to, the chemistry of the product, the desired concentration, the fluid used to erode the chemistry, frequency of use of the dispenser, along with other factors. For example, for normal use with water as the eroding element, it has been shown that it is preferred to have approximately one-quarter inch of the bottom portion of the product chemistry submerged to aid in controlling the erosion rate of the chemistry. This will provide for a more even erosion of the product as it is used, so that there will be less of a chance of an odd amount of product left that must be discarded or otherwise wasted.

The liquid will continue in a generally upwards orientation to come in contact with a portion or portions of the solid product supported by the product grate 50. The mixing of the liquid and the solid product will erode the solid product, which will dissolve portions of the solid product in the liquid to form a product chemistry. This product chemistry will be collected in the product chemistry collector 56, which is generally a cup-shaped member having upstanding walls and bottom floor comprising the manifold diffuse member 46. The product chemistry will continue to rise in the product chemistry collector 56 until it reaches the level of an overflow port 52, which is determined by the height of the wall comprising the product chemistry collector 56. According to an aspect, the product chemistry collector 56 is formed by the manifold diffuse member 46 and walls extending upward therefrom. The height of the walls determines the location of the overflow port 52. The product chemistry will escape or pass through the overflow port 52 and into the collection zone 42, in this case a funnel. The liquid source 34 includes a second path, which ends with the diluent nozzle 60. Therefore, more liquid may be added to the product chemistry in the collection zone 42 to further dilute the product chemistry to obtain a product chemistry having a concentration within the acceptable range.

Other components of the dispenser 10 include a splash guard 54 positioned generally around the top of the collection zone 42. The splash guard 54 prevents product chemistry in the collection zone 42 from spilling outside the collection zone 42.

Figure 4:
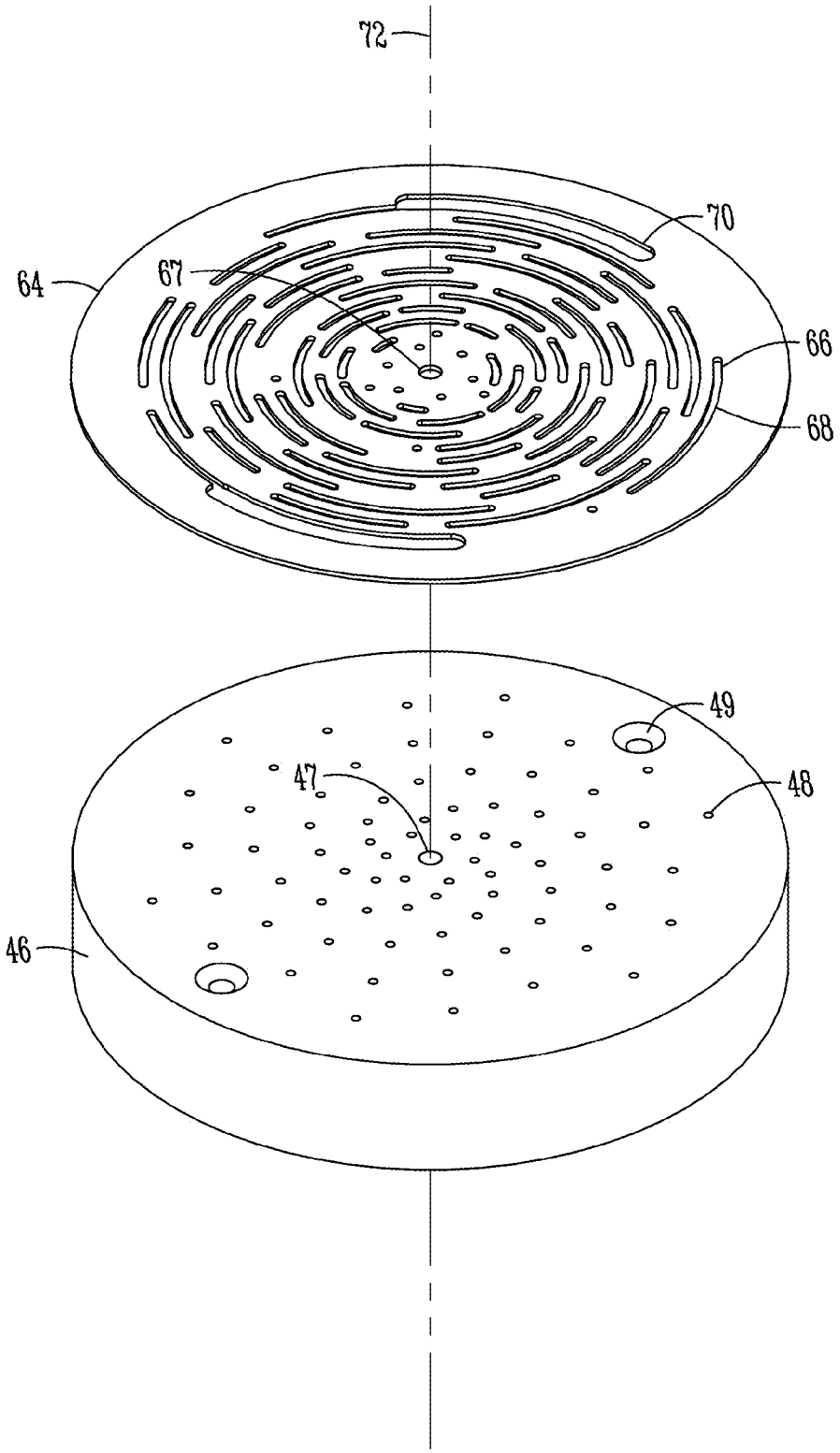
FIG. 4 is an exploded view of a manifold diffuse member and cover according to an embodiment for use with a dispenser.

FIG. 4 is an exploded view of a manifold diffuse member 46 and cover 64 according to an embodiment for use with a dispenser 10. As described above, the manifold diffuse member 46 is positioned generally between the liquid source and the product chemistry or solid product. Therefore, the manifold diffuse 46 controls some aspects of the flow of the liquid, such as controlling the turbulence of the liquid contacting the solid product, and controlling the type of flow, such as by controlling the angle of the ports. The ports 48 of the manifold diffuse member 46 can be configured to allow different flow rates, flow types, flow directions, volumetric flow, liquid turbulence, velocity, liquid current (Eddy, vortex shedding, etc.), through the manifold diffuse member 46 based upon the number of ports and orientation, positioning, size, and/or configuration of the ports 48. However, it may not be efficient to have to replace a manifold diffuse member 46 having different configurations of manifold diffuse ports 48 therethrough to adjust the flow of the liquid through the manifold diffuse member 46 every time that there is a change in the temperature of the liquid or another characteristic. Therefore, the cover 64 may be provided and attached to or configured to be positioned adjacent the manifold diffuse member 46. It should be noted that the cover 64 can be positioned at either side of the manifold diffuse member 46, and also that a cover can be positioned on both sides of the member 46 to provide for additional control of the blocking, obscuring, or alignment with the ports 48 of the diffuse member 46.

The cover 64 includes a plurality of cover ports 66 therethrough. The cover 64 shown in FIG. 4 includes a plurality of slots 68 radially positioned about the cover 64 constituting the ports 66. The cover 64 includes a central aperture 67 that may share an axis 72 with a central aperture 47 of the manifold diffuse member 46. The apertures may be aligned when positioning the cover 64 adjacent the manifold diffuse member 46. However, it should be appreciated that in some embodiments the apertures need not be aligned and/or that the manifold diffuse member 46 and the cover 64 need not share a common axis. In addition, while the configuration shown in FIG. 4 shows the cover on or adjacent the upper or top side or portion of the manifold diffuse member 46, it should also be appreciated that the cover 64 may be placed on the underside of the manifold diffuse member 46 as well.

Figure 5A:
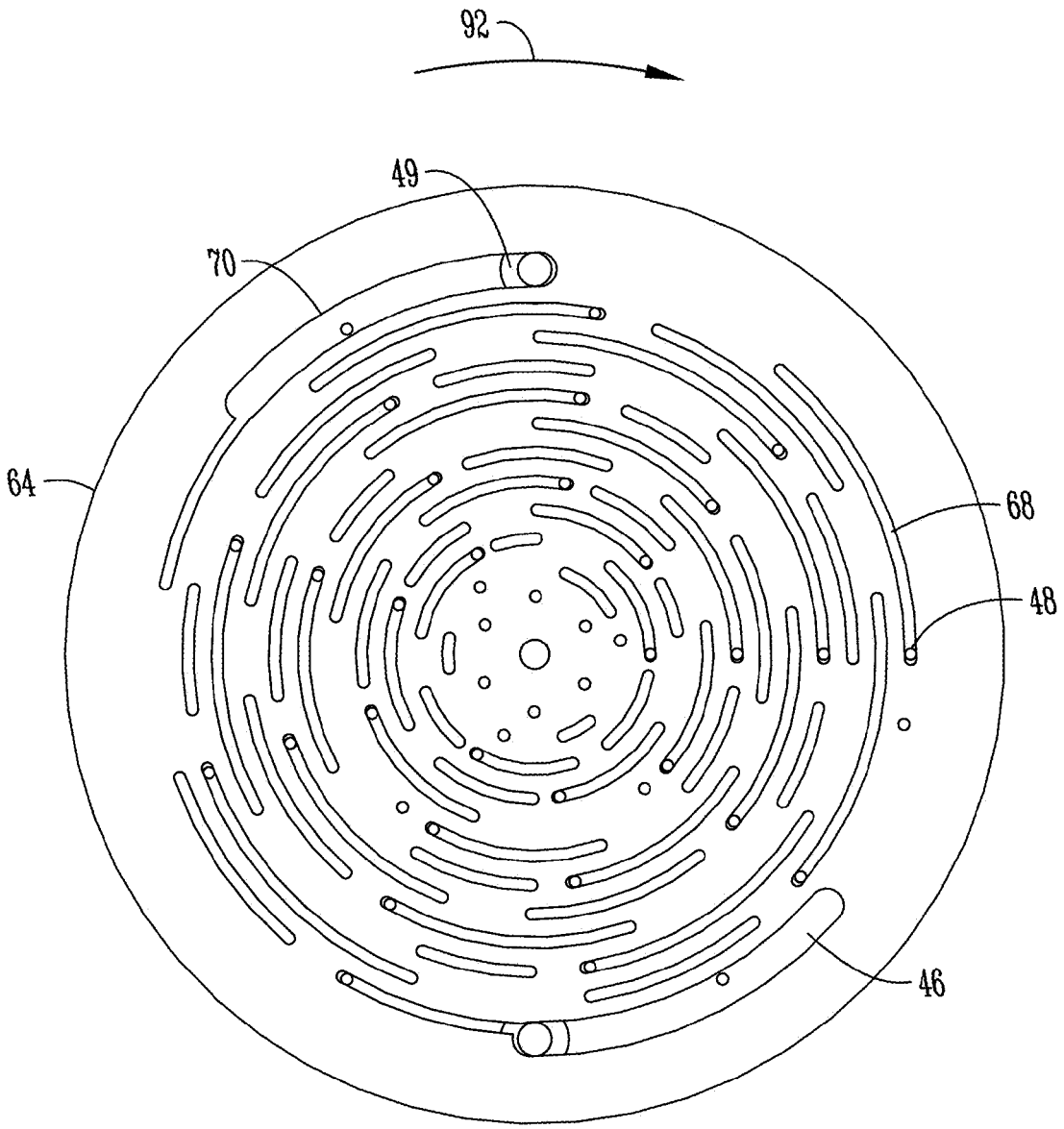
FIGS. 5A and 5B are views of the manifold diffuse member and cover wherein the cover has been rotated to adjust the alignment of manifold diffuse ports and cover ports.
Figure 5B:
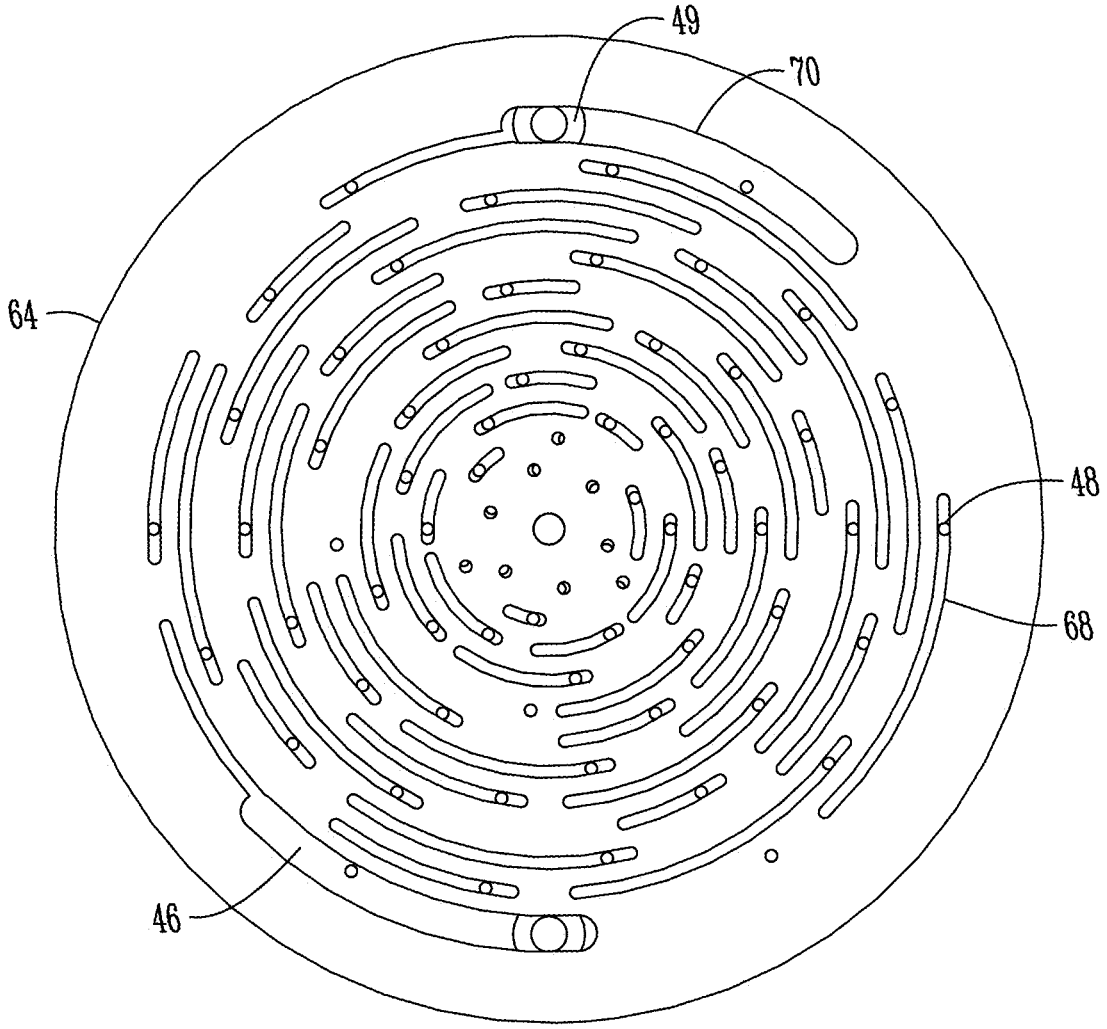

The cover 64 shown in FIGS. 4, 5A and 5B further comprises connector slots 70 positioned radially about the axis 72 of the cover 64. The connector slots 70 are sized slightly larger than the other slots 68 of the cover 64. Thus, a connector, such as a screw, pin, dowel, or the like, may be inserted through the connector slot 70 and further through a hole 49 in the manifold diffuse member 46 to attach the cover 64 to the manifold diffuse member 46. However, the connector (not shown) can be sized to extend through the connector slot 70 of the cover 64 such that the cover is able to rotate relative to the manifold diffuse member 46.

FIGS. 5A and 5B show multiple configurations of the cover 64 positioned relative to the manifold diffuse 46 to provide for different flow characteristics and/or turbulence of liquid passing therethrough and in contact with the solid product chemistry. As has been mentioned, flow characteristics of the liquid or fluid that may be varied include, but are not limited to, velocity, pressure, turbulence, temperature, flow rate, vector, impingement, and/or other stream or jet control. For example, as shown in FIG. 5A, the connector slots 70 are aligned generally with the manifold diffuse holes 49 for extending a connector therethrough. In such a configuration, a plurality of manifold diffuse ports 48 can be viewed through the plurality of slots 68 in the cover 64. Thus, in configuration shown in FIG. 5, a controlled amount of liquid would be able to pass through the ports 48 based on the configuration of the slots 68. While the manifold diffuse 46 includes more ports 48 than shown in FIG. 5A, the cover 64 has blocked these to reduce the amount of flow through the manifold diffuse member and in contact with the solid product chemistry.

However, a characteristic of the liquid or environment may change, thus necessitating a change in the flow characteristics of the liquid through the manifold diffuse member 46. For example, the temperature of the liquid may be reduced, which, due to known relationships, will more slowly erode the solid product chemistry to produce a product chemistry having a lower concentration. Therefore, a greater amount of liquid or a higher flow rate of liquid may be desired to pass through the manifold diffuse member 46 to accommodate the lower temperature, i.e., the higher flow rate of liquid through the manifold diffuse member 46 will raise the erosion rate and concentration of the product chemistry that was lost due to the lower temperature of the liquid. The turbulence of the liquid could also be raised.

To accomplish this, the cover 64 may be rotated in the direction shown by the arrow 92 in FIG. 5A. It is to be appreciated that while the cover 64 rotates, the manifold diffuse 46 will remain substantially stationary. The cover 64 can be rotated generally any amount, but is shown to have rotated a full range of rotation shown in FIG. 5B. This can be seen by noting the new location of the connector slot 70 relative to the hole 49 at the upper portion of FIG. 5B. Also note, due to the rotation of the cover 64, the slots 68 have changed configuration relative to the ports 48 of the manifold diffuse member 46. Thus, FIG. 5B shows a greater number of manifold diffuse ports 48 shown through the slots 68. Therefore, the configuration shown in FIG. 5B will allow for a higher flow turbulence or a greater amount of liquid to pass through the manifold diffuse member 46 and cover 64 and into contact with the solid product chemistry. The configuration shown in FIG. 5B will erode the solid product's chemistry at a higher rate than that shown in FIG. 5A. As can be appreciated, the configuration shown in FIG. 5A can be used with higher temperature liquid, while the configuration shown in FIG. 5B can be used with a lower temperature liquid. In addition, other characteristics, such as the distance from the manifold diffuse member to the solid product chemistry may also necessitate the change in configuration of the cover 64 relative to the manifold diffuse member 46 such that more or less manifold diffuse ports 48 are open to allow the liquid to pass therethrough. It should also be appreciated that the cover 64 can remain substantially stationary, while the manifold diffuse member 46 is rotated to adjust the flow therethrough, or that both the manifold diffuse and the cover are rotatable to adjust the flow of the liquid.

As mentioned, it should also be appreciated that, while the cover 64 is shown on the upper or top side of the manifold diffuse member 46, the cover 64 may also be positioned on the underside. When the cover 64 is positioned on the underside of the manifold diffuse member 46, the force of the flow of liquid from the liquid source nozzle 44 may aid in keeping the cover 64 pressed tightly against the manifold diffuse member 46 such that the liquid will not be allowed to sneak or pass through the manifold diffuse member unwantedly.

It should also be appreciated that the cover 64 can be adjusted, i.e., rotated, in the manner shown in FIGS. 5A and 5B either manually or automatically. For example, a sensor may be connected to a liquid source line such that the temperature of the liquid source can be viewed by an operator. When the operator notices a change in temperature of the liquid source, the operator may open the dispenser and physically rotate the cover based on the change in temperature to account this change in temperature. For instance, if the temperature suddenly rises, the cover 64 may be rotated to the configuration shown in FIG. 5A, wherein more manifold diffuse ports 48 are covered and blocked by the cover 64. The operator could simply rotate the cover, or turn a screw or other member positioned through the central apertures of the cover and manifold diffuse to rotate one or both of the components.

In addition, the cover may also be connected to rotational means and the sensor such that a change in temperature of the liquid will automatically cause the rotation of the cover 64 a predetermined amount to accommodate a change in temperature. The dispenser may include set locking points configured to provide for a predetermined amount of open manifold diffuse ports to allow the liquid to pass through.

The cover 64 may be generally any material capable of providing blocking and opening means for the ports 48 of the manifold diffuse member 46. For example, the cover 64 may be a molded plastic, such as polyethylene. However, it is to be appreciated that other types of materials, including rubbers and other elastomers, may be used as well.

Figure 6:
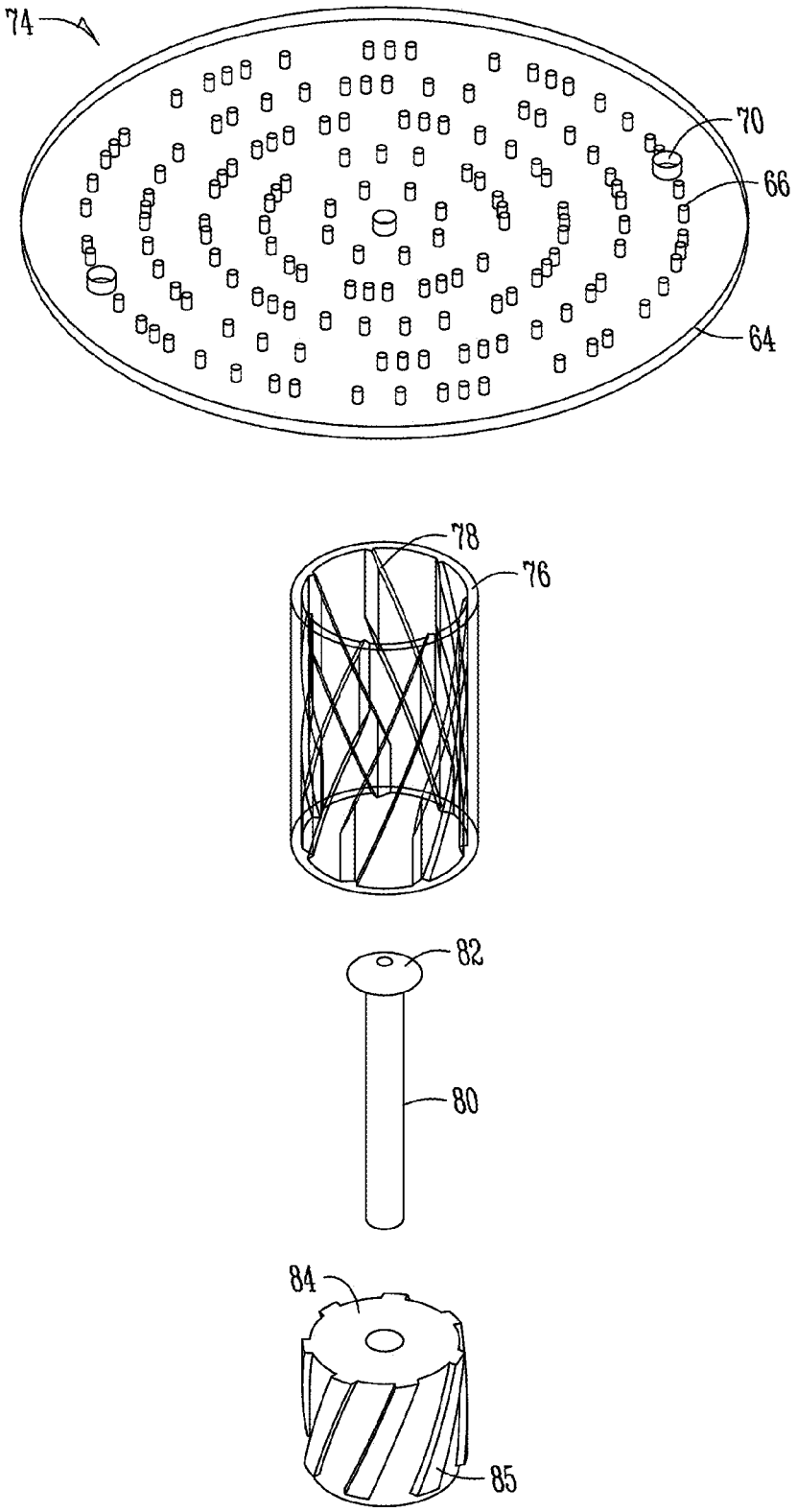
FIG. 6 is an exploded view of the cover assembly of FIG. 6.

FIG. 6 is an exploded view of a cover assembly 74 according to another embodiment of the invention. The cover 64 of the cover assembly 74 shown in FIG. 6 includes a plurality of cover ports 64 therethrough. The cover ports 66 are configured to be aligned and unaligned with the manifold diffuse ports 48 of the manifold diffuse member 46. Therefore, the number and configuration of the cover port 66 may be varied and positioned accordingly to allow the ports to align with the manifold diffuse ports 48 in some configurations, while blocking the manifold diffuse ports in other configurations. It should be noted that the cover 64 shown in FIG. 6 does not include slots, and therefore the connecting member or holes 70 shown in FIG. 6 will be different than that shown in FIGS. 4, 5A, and 5B. The cover assembly 74 also includes a ramped body 76 operably connected to the cover 64. The ramped body is a rigid member comprising a plurality of ramps on an internal surface thereof. The ramp body 76 shown in FIG. 6 is a generally a hollow, cylinder shaped object with the ramps 78 positioned radially on the interior wall of the member 76. Thus, the ramps 78 and ramp body may be molded.

Also shown in FIG. 6 is a thermal valve shaft 80 comprising a shaft cap 82 and a shaft member 84. As will be understood, the thermal valve shaft 80 is connected to the shaft member 84 such that movement of the shaft 80 will also cause the shaft member 84 to move as well in a linear or longitudinal direction. Also shown in FIG. 6 is a plurality of external ramps 85 positioned on the exterior or external surface of the shaft member 84. It should be appreciated that the ramps 85 of the shaft member 84 are configured to reside in and move relative to the internal ramps 78 of the ramp body 76. It should be noted that, while a thermal valve shaft is shown and described, any temperature sensitive or dependent device reacting to a change in temperature is contemplated for use with the present invention, and no specific device is limiting.

The thermal valve shaft 80 is connected to a thermal valve (not shown). The thermal valve is configured to extend and retract the thermal valve shaft 80 based on a change in temperature experienced by the thermal valve. For example, the thermal valve may have a phase change media within it such that a raising of temperature will cause the phase change media to melt, which will press on the thermal shaft 80 to extend the thermal shaft 80 away from the thermal valve. In addition, once the temperature has lowered, the shaft 80 can be allowed to retract back into or towards the thermal valve. Thus, the thermal valve shaft 80 and the shaft member 84 will extend and retract relative to the thermal valve according to a temperature experienced by the thermal valve, such as the temperature of the liquid in contact with the solid product chemistry.

As will be appreciated, the extending and retraction of the thermal shaft 80 and thus, the shaft member 84 relative to the ramped body 76 will cause the ramps 78, 85 to interact with one another, which will cause the ramped body 76 to rotate. As the ramped body 76 is connected to the cover 64, the rotation of the ramped body 76 will also cause the cover 64 to rotate likewise. This rotation will cause the cover port 66 and the manifold diffuse ports 48 to become aligned and unaligned as the cover 64 rotates. This will allow more or less liquid and/or liquid flow characteristics to be changed according to a change in the temperature of the liquid, such that the erosion rate and thus, concentration of the product chemistry formed will be maintained within an acceptable range.

Figure 7A:
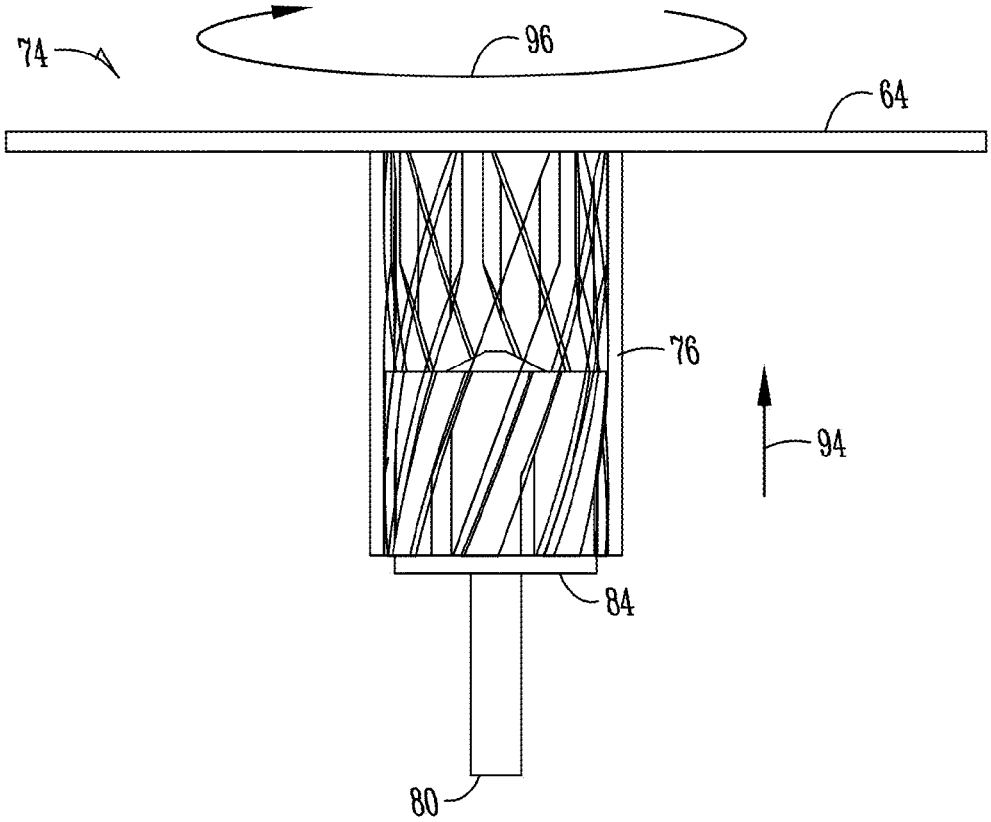
FIGS. 7A and 7B are views of the cover assembly showing various steps of the cover assembly rotation.
Figure 7B:
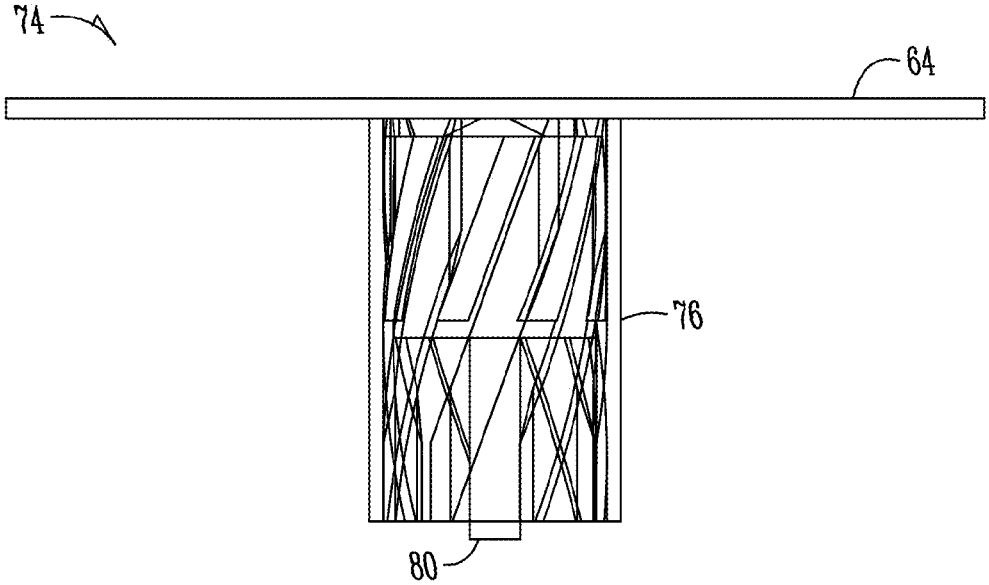

FIGS. 7A and 7B show an exemplary method and possible positions of the cover assembly 74 in action. The configuration in FIG. 7A shows the thermal valve shaft 80 in a fully retracted position relative to the ramped body 76. Thus, the shaft member 84 is at a lower end of the ramped body 76. However, if the thermal valve experiences a rise in temperature, the valve will cause the shaft member 80 to extend in the direction shown by the arrow 94 in FIG. 7A. As the shaft 80 extends, the shaft member 84 will also extend at the same rate and distance. The extension of the shaft 80 and shaft member 84 will cause the ramps 78 of the ramped body 76 to move along the ramp members 86 on the exterior of the shaft member 84. The ramp members and the ramps moving relative to one another will cause the ramp member 76 to rotate generally in the direction shown by the arrow 96 in FIG. 7A. This rotation will continue until the thermal valve has fully reacted to the rise in temperature of the liquid. Therefore, the rotation may be minor, or could be to the extent of that shown in FIG. 7B, which would be full extension of the thermal valve shaft 80.

As mentioned, as the ramp body 76 and cover 64 rotate due to the extension or retraction of the thermal valve shaft 80, the cover port 66 will become aligned or unaligned with the manifold diffuse ports 48 such that the cover may block the liquid or allow liquid to pass through the manifold diffuse member 46 and into contact with the solid product chemistry. Therefore, as the thermal valve causes the thermal valve shaft 80 and shaft member 84 from the configuration shown in FIG. 7A to the configuration shown in 7B, the cover 64 may be blocking more of the manifold diffuse member ports 48 such that less liquid is able to pass through and into contact with the solid product chemistry. This will account for the rise in temperature of the liquid, which can increase the erosion rate and thus concentration of the product chemistry formed between the liquid and the solid product chemistry. Thus, for the configuration shown in FIG. 7B, at a high temperature, the rotation of the cover 64 will be such that the cover 64 blocks or covers a greater number of manifold diffuse ports 48, such that low amounts of liquid are able to contact the solid product chemistry.

However, as mentioned and can be appreciated, the thermal valve is able to extend and retract the thermal valve shaft 80 any amount of the length of the shaft 80. Therefore, the configuration shown in FIGS. 7A and 7B, while being absolute, are not the only stopping points for the shaft member 84 relative to the ramp member 76. For example, a slight rise in temperature may cause the shaft 80 to extend slightly into the ramped member 76 such that only a small rotation of the cover 64 occurs. In addition, it should be appreciated that the cover assembly 74 provides for a generally automatic response or adjustment to the system such that the cover will automatically rotate based upon a change in temperature of the liquid to allow or block more liquid from passing therethrough to control the erosion rate and thus the concentration level of the product chemistry for between the liquid and the solid product chemistry. Thus, the cover assembly 74 does not require an operator to make any adjustments, and can make adjustments on the fly depending on the temperature of the liquid.

In addition, it should also be appreciated that the configuration of cover port 66 can be determined based upon known relationships between the temperature of the liquid and the erosion rate of the solid product chemistry. For example, it has been shown that it is a generally direct relationship between the raising of the temperature of the liquid and the erosion rate of the solid product chemistry in contact therewith (higher temperature means higher erosion rate). Therefore, the ports 66 of the cover 64 can be configured such that an ever-changing number of ports are blocked as the temperature is rising. In addition, other relationships may be determined between the liquid and the erosion rate of the solid product chemistry to cause the cover to rotate as a characteristic of the liquid changes to allow more or less liquid to pass through the manifold diffuse member 46 and into contact with the solid product chemistry.

Figure 8:
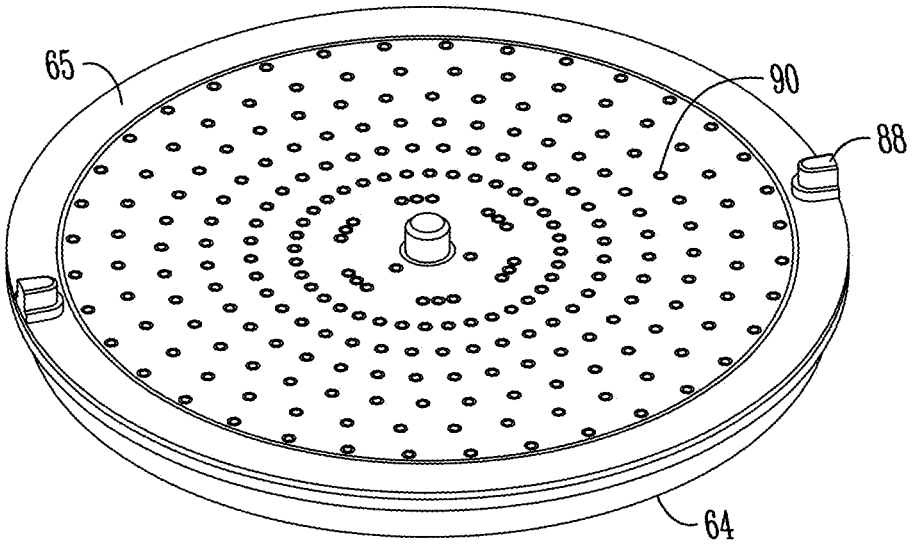
FIG. 8 is a perspective view of another cover having a molded portion attached to the cover and including open and closed ports.

FIG. 8 shows yet another embodiment of the cover 64 for use with the dispenser and manifold diffuse member 46. In the configuration shown in FIG. 8, the manifold diffuse 64 includes the plurality of ports 66 therethrough and having a configuration. In addition, the cover 64 of FIG. 8 includes a molded portion 65 attached to the cover 64. The molded portion 65 includes a number of closed ports 90 for blocking the cover port 66 of the cover 64. Thus, in extreme situations, the molded portion 65 may be changed to include more or less closed ports 90 to block or open more cover ports 66 for the cover 64. The molded portion 65 may be a rubber or other material that can be added to or removed from the cover 64, to allow for a generally infinite number of port blocking configurations.

Figure 9C:
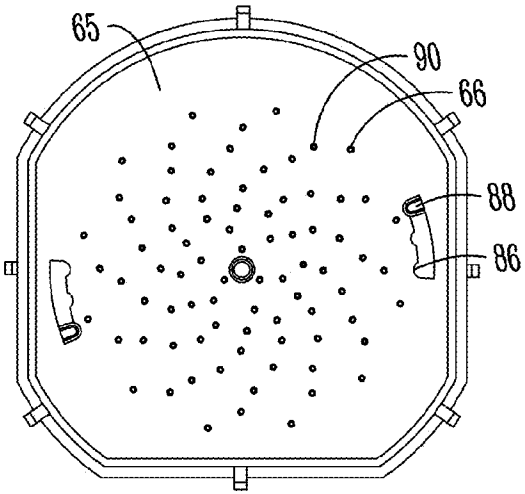
FIGS. 9A-9C are views of the cover of FIG. 8 in different configurations to provide a different number of open ports.
Figure 9B:
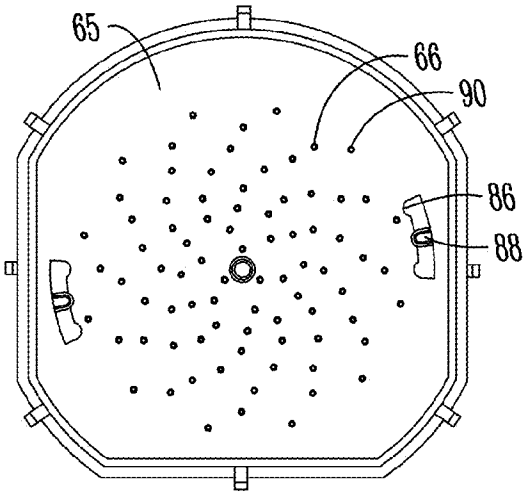
Figure 9A:
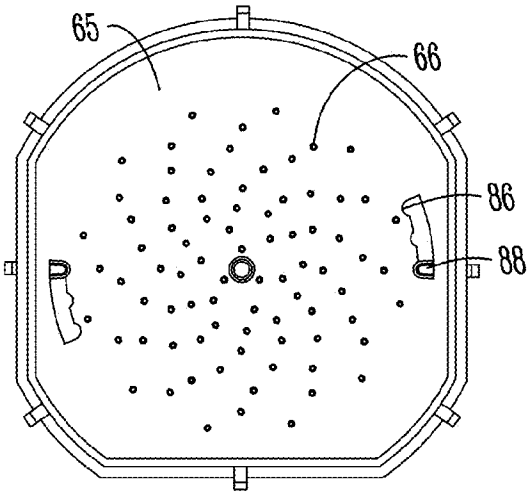

In addition, the cover 64 shown in FIG. 8 includes notches 88 extending therefrom. As shown in FIGS. 9A-9C, the notches 88 are configured to match with a slot in the manifold diffuse member 46 such that the notches 88 may be stopped at locking points 86. The notches may be considered detents that are used to provide feedback for the user to allow the user to rotate the cover 64 and to know when the cover 64 is at one of the locking points 86. The locking points are radial components to limit the rotation of the cover 64 relative to the manifold diffuse member 46.

For instance, in the configuration shown in FIG. 9A, the notches 88 of the cover 64 are held in place at the locking point 86 of the manifold diffuse member 46. Thus, in the configuration shown in FIG. 9A, the cover port 66, including ports through the molded portion 65 are arranged such that they do not block many, if any, of the manifold diffuse ports 48. Thus, FIG. 9A shows a generally wide open manifold diffuse member 46 to allow a flow turbulence for the liquid to pass therethrough.

In FIG. 9B, the cover 64 has been rotated such that the notches 88 are held in place a second locking point 86 of the manifold diffuse member 46. In this configuration, more of the manifold diffuse ports 48 have been blocked by the cover 64 and/or molded portions 65. Therefore, the configuration shown in FIG. 9B will have a higher velocity and turbulent flow than the configuration shown in FIG. 9A, which will actually erode more product than using the configuration of FIG. 9A.

Furthermore, FIG. 9C shows the notches 88 in a third locking point 86 wherein the cover 64 and/or molded portion 65 block an even greater number of manifold diffuse ports 48. The configuration shown in FIG. 9C will have the highest turbulence of the liquid passing through the manifold diffuse member 46 and into contact with the solid product chemistry, which will provide the highest erosion rate of the solid product chemistry. Therefore, as the temperature of the liquid decreases, the number of open ports could be reduced to account for the slower erosion rate of the temperature of the liquid. For instance, the configuration shown in FIG. 9A may include 81 open ports to allow the liquid to pass therethrough. The configuration shown in FIG. 9B may only include 48 open ports to allow liquid to pass therethrough, and the configuration shown in FIG. 9C may allow only 24 holes or ports to allow the liquid to pass therethrough. While a certain number of ports have been disclosed, it is to be appreciated that these are not the only number of holes that may be open or closed by the configurations of the present invention. The present invention contemplates that the rotation of the cover 64 relative to the manifold diffuse member 48 may allow generally any number of ports to remain open to allow the liquid to pass therethrough.

Including a cover 64 with the manifold diffuse member 46 as disclosed in the invention will provide numerous benefits and advantages. For example, controlling the turbulence and/or flow characteristics of the liquid through the manifold diffuse member will aid in controlling the erosion rate of the solid product chemistry by the liquid. This will in turn control the concentration of the product chemistry formed between the liquid and the solid product chemistry. The controlling of the turbulence and/or flow characteristics and thus erosion rate will also allow for a more uniform erosion of the solid product chemistry in the product holder. Thus, knowing the erosion rate and estimated time of erosion for the solid product chemistry will allow a business to pre-plan and pre-order a number of solid product chemistries for an extended period of time, such as a year.

Because the covers of the present invention will aid in controlling the erosion rate of the product chemistries, the business should feel secure in relying on the erosion rate and when the solid product will need be replaced in a dispenser. In addition, the cover of the present invention will account for any extreme measures or changes in the liquid. For example, it has been determined that, in order to speed up a cleaning process, a worker may increase the temperature of the liquid in contact with the solid product to obtain the higher chemistry of cleaning products such that the cleaning product will require less time. In turn, this will cause the product to erode at a greater rate and possibly in a non-uniform manner. Doing so will decrease the time period between replacing the solid product, and can also cause damage to products based on the higher concentration. The cover the present invention will take into account a work attempting this to allow for a lower flow turbulence to pass therethrough when a higher temperature is selected. This lower flow turbulence will counterbalance the higher temperature to reduce the erosion rate of the solid product and to provide uniform erosion on the product. Thus, the business can have a higher security knowing that the product is eroding at a generally uniform time and manner such that they should know when a new product needs to be replaced in a dispenser. It will also protect many products by not allowing a product chemistry having a higher concentration to be dispensed from the outlet of the dispenser.

While the ports and other apertures for allowing a liquid or other fluid to pass through have been described as being, the more passing, the higher the erosion, it should be noted and included in the invention that this sometimes can be different. At a certain point, the amount of liquid contacting a product chemistry will not affect the erosion rate, and instead will simply change the turbulence of the flow in contact with the chemistry.

Furthermore, the manifold diffuse members of the present invention may comprise molded plastics, over molded rubbers, or the like. Other components may include gaskets to aid in sealing, and other elastomers.

The foregoing description has been presented for purposes of illustration and description, and is not intended to be an exhaustive list or to limit the invention to the precise forms disclosed. It is contemplated that other alternative processes obvious to those skilled in the art are to be considered in the invention. For example, while ports and slots have been shown formed through the covers of the various embodiments of the present invention, these are not the only configurations allowed. It is contemplated that generally any configuration of holes, slots, ports, or the like through a cover may be included in the present invention. In addition, the blocking and unblocking of the manifold diffuse port may be configured based upon the different types of solid product chemistries, as well as the different types of liquid in contact therewith. It is to be understood that the present invention provides the advantage of being able to adjust the liquid turbulence of a liquid in contact with a solid product chemistry to account for a change in the characteristic of the turbulence or solid product to maintain a predetermined concentration of the product chemistry and to provide a generally uniform erosion rate for the solid product chemistry.

What is claimed is:

1. A method for obtaining a solution from a product chemistry and a fluid, comprising:

providing the product chemistry;

introducing the fluid through a plurality of manifold diffuse member ports in a manifold diffuse member positioned adjacent the product chemistry; and adjusting characteristics of the flow of the fluid through the manifold diffuse member ports in the manifold diffuse member by selectively blocking or unblocking at least some of the manifold diffuse member ports with a cover to obtain and maintain a concentration or amount of the solution, the cover having asymmetrically arranged and radially positioned cover slots to provide various potential configurations, each configuration blocking a different number of manifold diffuse member ports;

wherein the cover is attached to a molded portion having closed ports for blocking the at least some of the manifold diffuse member ports or at least some of the cover slots;

wherein the asymmetrically arranged and radially positioned cover slots are not symmetric about any axis on the surface of the manifold diffuse member; and wherein the amount of liquid allowed through the ports modifies the turbulence of the liquid, which modifies the erosion rate of the product chemistry.

2. The method of claim 1, wherein the cover has connector slots sized larger than the cover slots positioned radially about the cover.

3. The method of claim 1, wherein the cover comprises a plurality of cover ports therethrough adjacent the manifold diffuse member.

4. The method of claim 3, further comprising rotating the cover to adjust the alignment of the cover ports and the manifold diffuse member ports to adjust characteristics of the flow of the fluid.

5. The method of claim 4, wherein the step of rotating the cover comprises manually rotating the cover between preset locations.

6. The method of claim 4, wherein the step of rotating the cover comprises extending or retracting a temperature dependent device operatively connected to one or more ramps of the cover to adjust the alignment of the manifold diffuse member ports and the cover ports.

7. An automated method for controlling a concentration of a combination of a product chemistry and a fluid in a dispenser, the automated method comprising:

combining the fluid and the product chemistry in a manner in which the fluid is added with a first turbulence through a manifold diffuse member;

sensing, via a sensor, at least one characteristic of the first turbulence before or during the combination of the fluid and the product chemistry; and based upon the at least one characteristic sensed, automatically adjusting the first turbulence to a second turbulence in order to control the concentration of the combination of the product chemistry and the fluid in the dispenser;

wherein the first turbulence comprises flow of the fluid through a cover on the manifold diffuse member, said cover having a plurality of asymmetrically arranged and radially positioned apertures, the asymmetrically arranged and radially positioned cover slots not being symmetric about any axis on the surface of the manifold diffuse member, the cover being attached to a molded portion having closed ports for blocking the at least some of the manifold diffuse member ports or at least some of the cover slots, and the fluid passing through a first set of apertures associated with the first turbulence.

8. The automated method of claim 7, wherein the step of automatically adjusting the first turbulence is done in real time.

9. The automated method of claim 7, further comprising detecting an environmental condition associated with the dispenser, and further comprising automatically adjusting the first turbulence based upon the detected environmental condition.

10. The automated method of claim 9, wherein the environmental condition comprises a climate condition of a room in which the dispenser is located.

11. The automated method of claim 7, wherein the step of automatically adjusting the first turbulence to the second turbulence comprises adjusting one or more of the fluid's velocity, pressure, temperature, flow rate, vector, or impingement.

12. The automated method of claim 7, wherein the step of automatically adjusting the first turbulence to the second turbulence comprises rotating the cover relative to the manifold diffuse member to allow the fluid to pass through a different set of apertures.

13. The automated method of claim 12, wherein the step of rotating the cover relative to the manifold diffuse member comprises automatically rotating the cover between preset locations.

14. The automated method of claim 13, wherein the step of rotating the cover relative to the manifold diffuse member comprises extending or retracting a temperature dependent device operatively connected to one or more ramps of the cover.

15. The automated method of claim 7, wherein the at least one characteristic sensed comprises the temperature of the fluid.

* * * * *